US011479044B2

(12) United States Patent
Bridges et al.

(10) Patent No.: US 11,479,044 B2
(45) Date of Patent: Oct. 25, 2022

(54) SOLVENT SUPPLY TUBE ARRANGEMENT

(71) Applicant: Domino UK Limited, Cambridge (GB)

(72) Inventors: Richard Thomas Calhoun Bridges, Cambridge (GB); Stuart Mark Walkington, Cambridge (GB)

(73) Assignee: Domino UK Limited

( * ) Notice: Subject to any disclaimer, the term of this patent is extended or adjusted under 35 U.S.C. 154(b) by 26 days.

(21) Appl. No.: 17/264,978

(22) PCT Filed: Jul. 29, 2019

(86) PCT No.: PCT/GB2019/000105
§ 371 (c)(1),
(2) Date: Feb. 1, 2021

(87) PCT Pub. No.: WO2020/025914
PCT Pub. Date: Feb. 6, 2020

(65) Prior Publication Data

US 2021/0245517 A1 Aug. 12, 2021

(30) Foreign Application Priority Data

Jul. 30, 2018 (GB) ..... 1812395

(51) Int. Cl.
*B41J 2/175* (2006.01)

(52) U.S. Cl.
CPC ..... *B41J 2/175* (2013.01)

(58) Field of Classification Search
CPC ..... B41J 2/165; B41J 2/18; B41J 2/175
See application file for complete search history.

(56) References Cited

U.S. PATENT DOCUMENTS

| | | | |
|---|---|---|---|
| 6,145,954 | A | 11/2000 | Moore |
| 6,158,854 | A | 12/2000 | Watts et al. |
| 6,550,889 | B2 | 4/2003 | Colombat et al. |
| 9,016,844 | B2 | 4/2015 | Morgan et al. |
| 2005/0285892 | A1 | 12/2005 | Harada et al. |
| 2009/0189960 | A1 | 7/2009 | Matsuda et al. |
| 2010/0066790 | A1 | 3/2010 | Kotabe et al. |

(Continued)

FOREIGN PATENT DOCUMENTS

| | | | |
|---|---|---|---|
| CN | 201214310 | Y | 4/2009 |
| CN | 201214311 | Y | 4/2009 |
| CN | 207565153 | U | 7/2018 |

(Continued)

*Primary Examiner* — An H Do
(74) *Attorney, Agent, or Firm* — Price Heneveld LLP

(57) ABSTRACT

A print head (10) for a continuous inkjet printer has an ink drop generator (12), an ink supply tube (14) connected to the ink drop generator (12), and a solvent supply tube (16) connected at a first end to the ink drop generator (12) and for connection at a second end to a solvent reservoir. The solvent supply tube (16) is provided with ink flow restriction means (24, 26) for restricting a flow of ink from the ink drop generator (12) into the solvent supply tube (16). The flow restriction means (24, 26) comprise an arrangement (24) of the solvent supply tube (16) such that, for a flow direction reversing portion (26) of the solvent supply tube (16) at the first end of the solvent supply tube (16), a flow of solvent from the second end to the first end of the solvent supply tube (16) flows away from the ink drop generator (12). Also a printer including such a print head and a former for use with such a print head.

9 Claims, 2 Drawing Sheets

(56) References Cited

U.S. PATENT DOCUMENTS

2012/0194619 A1 8/2012 Smith et al.

FOREIGN PATENT DOCUMENTS

| | | | |
|---|---|---|---|
| EP | 1405728 | A1 | 4/2004 |
| EP | 2209640 | B1 | 5/2012 |
| EP | 2631075 | A2 | 8/2013 |
| GB | 2316364 | A | 2/1998 |
| JP | H0577439 | A | 3/1993 |
| JP | H0976527 | A | 3/1997 |
| JP | H10324000 | A | 12/1998 |
| JP | 2001253093 | A | 9/2001 |
| JP | 2003326733 | | 11/2003 |
| JP | 2004299324 | A | 10/2004 |
| JP | 2015-136934 | A | 7/2015 |
| JP | 2015160881 | | 9/2015 |
| JP | 2017136796 | | 8/2017 |
| WO | 9828146 | A1 | 7/1998 |
| WO | 2007129110 | A2 | 11/2007 |
| WO | 2009047503 | A1 | 4/2009 |
| WO | 2009049130 | A1 | 4/2009 |
| WO | 2015095927 | A1 | 7/2015 |

SOLVENT SUPPLY TUBE ARRANGEMENT

FIELD OF THE INVENTION

This invention relates to a print head for an inkjet printer, to an inkjet printer including such a print head, and to a former for a solvent supply tube of such a print head.

BACKGROUND TO THE INVENTION

A continuous inkjet (CIJ) printer is operable to generate a continuous stream of drops of an electrically conductive ink, and to apply electrical charges to selected ones of the ink drops to cause them to be projected from a print head onto a printing substrate, or to enter a gutter in the print head and be returned to an ink reservoir.

In addition to an ink reservoir, the CIJ printer has a solvent reservoir, solvent from the solvent reservoir being used to replace solvent lost to evaporation from the ink as the ink is circulated between the ink reservoir and the print head, and to flush ink from the print head before shut down, so as to prevent the ink from clogging the print head.

For correct operation of the CIJ printer, precise synchronisation of the generation of the ink drops and the application of the electrical charges to selected ones of the drops is required. The process of adjustment of the printer to obtain this synchronisation is known as "phasing" and is carried out by the printer itself. Frequent phasing is required during operation of the printer, e.g., in response to changes in ink viscosity due to changes in ambient temperature.

The inventors have observed that if phasing is carried out when a print head of a CU printer is pointing downwards, the phasing may fail if the print head is subsequently pointed upwards.

The inventors have also observed that when a CIJ printer is first started, phasing may take very much longer if a print head of the printer is pointing upwards than if the print head is pointing downwards.

The inventors have established that the cause of these CIJ printer behaviours is that when the print head is pointing upwards, ink, which is more dense than the solvent, flows from an ink supply tube connected to the print head into a solvent supply tube connected to the print head, displacing solvent from the solvent supply tube into the print head, which causes a viscosity of the ink to reduce in an unexpected manner and the phasing to fail.

JP H10-324000 shows a CU printer, the solvent supply tube of which is provided with a non-return valve that would limit a flow of ink from the ink supply tube into the solvent supply tube. EP 1 405 728, US 2012/194619 and JP H5-77439 show similar such CIJ printers.

WO 2009/047503 shows a CU printer of which the solvent supply tube is provided with a flow control valve that would limit a flow of ink from the ink supply tube into the solvent supply tube. WO 2009/049130, US 2009/189960 and US 2010/066790 show similar such CU printers.

The non-return valves of JP H10-324000 et c. are mechanical devices with moving parts that are exposed in use to ink. In addition to increasing the costs of manufacture of such printers, the valves can be expected to reduce the reliability of such printers as a result of build-up of ink on the moving parts of the valves.

Because the flow control valves of WO 2009/047503 etc. are located in the printer bodies, rather than the print heads, although they would eventually limit the flow of ink from the ink supply tubes into the solvent supply tubes, this limiting effect would be too small to be useful. That is to say, the flow of ink into the solvent supply tubes would stop only once the solvent supply tubes connecting the print heads and the printer bodies, which tubes may be several meters in length, had filled with ink.

SUMMARY OF THE INVENTION

According to a first aspect of the invention there is provided a print head for an inkjet printer, the print head comprising an ink drop generator, an ink supply tube connected to the ink drop generator, and a solvent supply tube connected at a first end to the ink drop generator and for connection at a second end to a solvent reservoir, the solvent supply tube being provided with ink flow restriction means for restricting a flow of ink from the ink drop generator into the solvent supply tube, wherein the ink flow restriction means comprise an arrangement of the solvent supply tube such that, for a flow direction reversing portion of the solvent supply tube at the first end of the solvent supply tube, a flow of solvent from the second end to the first end of the solvent supply tube flows away from the ink drop generator.

The invention can provide a print head that, when connected to a printer, significantly limits a flow of ink from the ink drop generator into the solvent supply tube without the use of a valve.

Preferably the flow direction reversing portion of the solvent supply tube is located less than 10 cm, more preferably less than 5 cm and, still more preferably, less than 3 cm from the ink drop generator.

The solvent supply tube may advantageously be arranged such that the flow direction reversing portion of the solvent supply tube forms part of a Z-shaped, S-shaped or U-shaped arrangement of the solvent supply tube.

Preferably, however, the solvent supply tube is arranged with a loop, of which the flow direction reversing portion of the solvent supply tube forms a part.

Arranging the solvent supply tube with a loop is a particularly elegant embodiment of the invention, because it does not require any other modification of the print head, such as a guide in which the solvent supply tube is located, to form the ink flow restriction means.

This makes it feasible to retrofit print heads with the invention, even print heads that form part of installed inkjet printers.

In a preferred embodiment of the invention the print head further comprises a former for the loop, the former being configured to receive and secure a loop of the solvent supply tube.

The former provides consistency between print heads, because it ensures that the loop is of a predetermined diameter.

According to a second aspect of the invention there is provided an inkjet printer including a print head in accordance with the first aspect of the invention.

Preferably the inkjet printer is a continuous inkjet printer.

According to a third aspect of the invention there is provided a former for a solvent supply tube, the former comprising a receiving portion for receiving a loop of a solvent supply tube to define a minimum internal diameter of the loop of the solvent supply tube, and a securing portion for securing at least a portion of the loop of the solvent supply tube in engagement with the receiving portion of the former, wherein the former comprises at least two bars with at least one of a receiving portion and a securing portion at each end of each bar.

Where the former comprises two bars, the two bars are preferably joined at their midpoints and arranged substantially at right angles to one another.

In a preferred embodiment a first bar of the two bars is provided with a receiving portion at each end and a second bar of the two bars is provided with a securing portion at each end.

Preferably the receiving portion is constituted by a pair of fingers.

Preferably the securing portion is constituted by at least one aperture for receiving and securing the solvent supply tube.

In a preferred embodiment one of the securing portions is constituted by a single aperture and the other of the securing portions is constituted by a pair of apertures arranged side by side.

BRIEF DESCRIPTION OF THE DRAWINGS

The invention will now be described, by way of example, with reference to the attached drawing figures, in which.

DETAILED DESCRIPTION OF EMBODIMENTS

Figure 1:
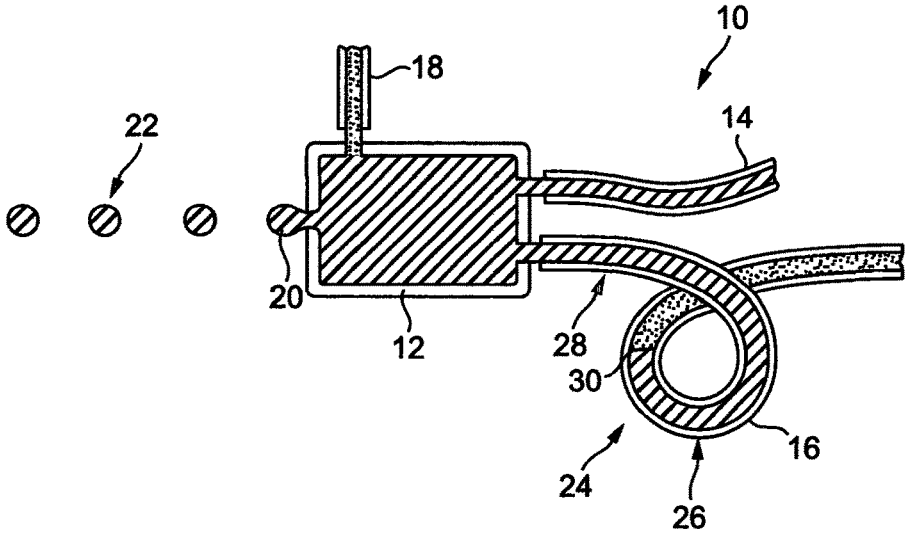
FIG. 1 is a schematic diagram of a print head in accordance with the invention.

The print head 10 of FIG. 1 comprises an ink drop generator 12 connected to an ink reservoir (not shown) by an ink supply tube 14 and connected to a solvent reservoir (not shown) by a solvent supply tube 16. A bleed tube 18 is also connected to the ink drop generator 12.

In use of the print head 10 ink (represented in FIG. 1 by hatching) is pumped into the ink drop generator 12 through ink supply tube 14. The ink fills the ink drop generator 12 and a jet of ink, denoted by reference numeral 20, is ejected from a nozzle of the ink drop generator 12. An electromechanical oscillator (not shown) that forms part of the ink drop generator causes the jet 20 of ink to break up into a stream of drops, denoted generally by reference numeral 22.

After use of the print head 10, solvent is pumped into the ink drop generator 12 through solvent supply tube 16 and out of the ink drop generator through bleed tube 18, in order to flush ink from the ink drop generator. At the end of the flushing process the flow of solvent through the solvent supply tube 16 is interrupted by closing a valve, leaving the solvent supply tube 16 filled with solvent (represented in FIG. 1 by stippling).

It will be appreciated that the operation of the print head 10 as described so far is conventional:

In accordance with the invention, however, the solvent supply tube 16 is provided with ink flow restriction means in the form of arrangement of the solvent supply tube 16 with a loop, denoted generally by reference numeral 24, so as to form a flow direction reversing portion, denoted generally by reference numeral 26, of the solvent supply tube 16.

For the avoidance of doubt, the flow direction reversing portion is so called because during the flushing process, solvent flows from the solvent reservoir to the ink drop generator 12 through the solvent supply tube 16. Although the direction of flow of the solvent relative to the solvent supply tube 16 is always from the ink reservoir end of the tube towards the ink drop generator end of the tube, in the flow direction reversing portion 26 of the solvent supply tube 16 the direction of flow of the solvent relative to the ink drop generator 12 is away from the ink drop generator.

The flow direction reversing portion 26 of the solvent supply tube is located approximately 2.5 cm from the ink drop generator 12. The flow reversing portion 26 and the ink drop generator 12 are contained in a print head housing (not shown) that is attached to a printer body (not shown) by a so-called umbilical (not shown). Such print head housings and printer bodies will be familiar to those skilled in the art from, e.g., Domino UK Limited's Ax-Series range of CIJ printers.

When a CIJ printer that includes the print head 10 is started up, the ink drop generator 12 fills with ink from the ink supply tube 14. The ink has a greater density than the solvent, which causes some of the ink in the ink drop generator 12 to flow under the influence of gravity into the solvent supply tube 16, from which it displaces a corresponding volume of the solvent into the ink drop generator 12.

The flow of ink into the solvent supply tube 16 continues until an equilibrium is reached, when the ink has displaced the solvent from the flow direction reversing portion 26 of the solvent supply tube 16 and an end portion 28 of the solvent supply tube 16 between the ink drop generator 12 and the flow reversing portion 26.

FIG. 1 shows the equilibrium and a resulting interface 30 between the ink and the solvent in the solvent supply tube 16.

The solvent displaced into the ink drop generator 12 by the flow of ink into the solvent supply tube 16 may cause the phasing to fail. However, the flow direction reversing portion 26 of the invention limits the volume of ink that flows into the solvent supply tube 16, and hence limits the volume of solvent that flows into the ink drop generator 12.

The result is that if phasing is carried out when the print head of the invention is pointing downwards, and the print head is subsequently pointed upwards, although the phasing may still initially fail, the limited volume of solvent that has flowed into the ink drop generator will quickly be discharged from the ink drop generator and normal phasing will quickly be resumed.

Similarly, if the print head of the invention is pointing upwards when the printer is first started, the volume of solvent that flows into the ink drop generator is limited and the solvent will quickly be discharged from the ink drop generator, so that phasing takes very little longer than if the print head had been pointing downwards when the printer was first started.

A particular advantage of the invention is that it makes the behaviour of the print head more predictable. That is to say, any phasing failure due to orientation of the print head should take no longer to resolve than the time required to establish the equilibrium shown in FIG. 1, which is typically no more than a few tens of seconds. In the absence of the invention, the behaviour of the print head in this regard could be highly unpredictable, being determined by factors such as the relative heights of the print head and the printer, or a length of an umbilical connecting the print head to the printer.

Figure 2:
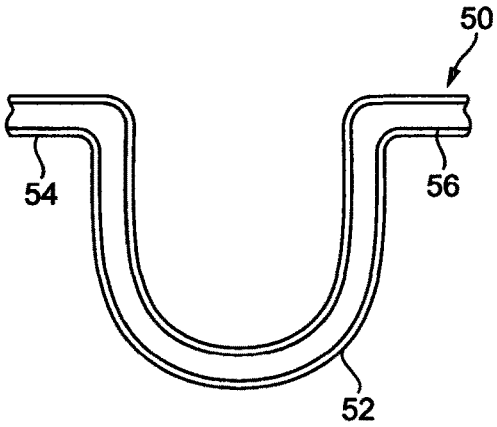
FIGS. 2 and 3 are schematic diagrams of alternative arrangements of solvent supply tubes for use in print heads in accordance with the invention.
Figure 3:
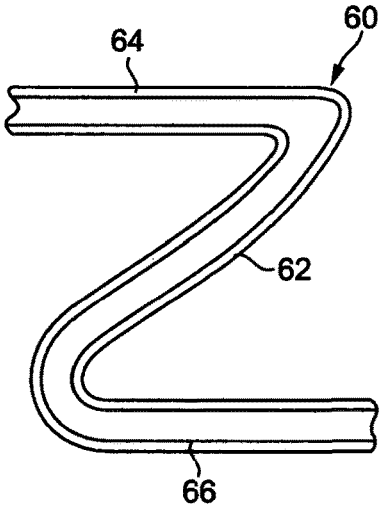

FIGS. 2 and 3 show solvent supply tubes with alternative arrangements of the flow direction reversing portion to that shown in FIG. 1.

The solvent supply tube 50 of FIG. 2 comprises a flow direction reversing portion 52 between first and second end portions 54 and 56, respectively. The flow direction reversing portion 52 can be seen to be U-shaped.

It will be appreciated that the U-shaped flow direction reversing portion 52 of FIG. 2 will operate nearly as well as the arrangement shown in FIG. 1 provided that a print head to which the solvent supply tube 50 is attached is not angled so that the first end portion 54 is vertically above the second end portion 56.

The flow direction reversing portions of FIGS. 1 to 3 limit a flow of ink into a solvent supply tube by constraining the ink, at some point in the flow direction reversing portion, to flow upwards to form a head of ink that acts to prevent any further flow of ink into the solvent supply tube.

It can be seen from FIG. 2 that if the solvent supply tube 50 were arranged with the first end portion 54 vertically above the second end portion 56, such a head of ink would not form and the flow of ink into the solvent supply tube 50 would not be restricted.

The solvent supply tube 60 of FIG. 3 comprises a Z-shaped flow direction reversing portion 62 between first and second end portions 64 and 66, respectively.

The Z-shaped flow direction reversing portion 62 will operate regardless of its orientation. Nevertheless, the looped arrangement of the solvent supply tube 16 shown in FIG. 1 is preferable because it requires less space and, in a very simple form, could be implemented by looping the solvent supply tube 16 and fastening it to itself using a cable tie.

Figure 4:
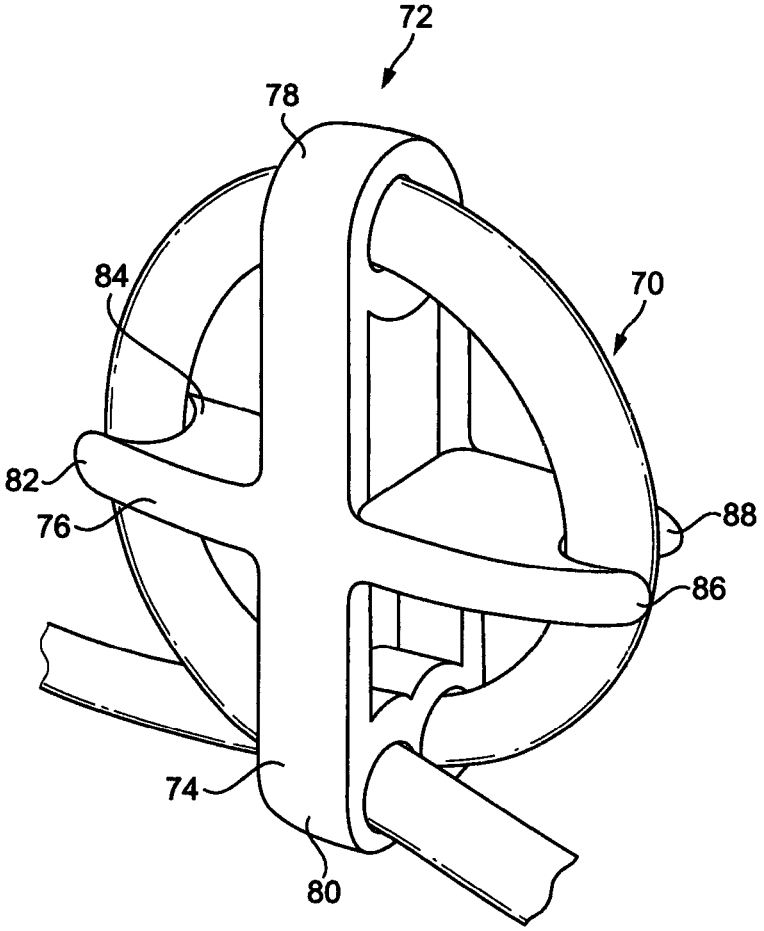
FIG. 4 is a perspective view of a former in accordance with the invention in use with a solvent supply tube of a print head in accordance with the invention.

Turning to FIG. 4, this shows part of a solvent supply tube, denoted generally by reference numeral 70, formed into a loop by a former in accordance with the invention, denoted generally by reference numeral 72. It is to be noted that the solvent supply tube forms the loop by bending round and crossing itself.

The former 72 is constituted by first and second bars 74 and 76, respectively, integrally formed with, and arranged at right angles to, one another. The first bar 74 is provided at its ends with securing portions and receiving portions, the securing and receiving portion at a first end 78 of the first bar being in the form of a single aperture for receiving the solvent supply tube 70, and the securing and receiving portion at a second end 80 of the first bar 74 being in the form of a pair of apertures arranged side by side for receiving the solvent supply tube 70.

The second bar 76 is provided at its first end with a receiving portion in the form of a pair of fingers 82 and 84, and at its second end with a receiving portion in the form of a pair of fingers 86 and 88.

In use of the former 72, the end of the solvent supply tube 70 that is to be connected to an ink drop generator of a print head is passed in a first direction through a first aperture of the pair of apertures in the second end 80 of the first bar 74, between the fingers 82 and 84 at the first end of the second bar 76, in a second, opposite direction through the single aperture in the first end 78 of the first bar 74, between the fingers 86 and 88 at the second end of the second bar 76, and in the first direction through the second aperture of the pair of apertures in the second end 80 of the first bar 74.

By pulling on the ends of the solvent supply tube 70, the tube engages with the second bar 76, and engages with, and is secured in place by, the apertures in the first bar 74. The engagement of the tube 70 with the second bar 76 and the apertures in the first bar determines a minimum internal diameter of a loop formed by the solvent supply tube. The former 72 removes a characteristic of the solvent supply tube that might otherwise be variable and therefore improves consistency of manufacture and performance of print heads in accordance with the invention.

It will be appreciated that the above description relates only to four embodiments of the invention, and that the invention encompasses other embodiments as defined by the claims.

The invention claimed is:

1. A print head for an inkjet printer, the print head comprising an ink drop generator, an ink supply tube connected to the ink drop generator, and a solvent supply tube connected at a first end to the ink drop generator and for connection at a second end to a solvent reservoir, the solvent supply tube being provided with ink flow restriction means for restricting a flow of ink from the ink drop generator into the solvent supply tube, wherein the ink flow restriction means comprise an arrangement of the solvent supply tube such that, for a flow direction reversing portion of the solvent supply tube at the first end of the solvent supply tube, a flow of solvent from the second end to the first end of the solvent supply tube flows away from the ink drop generator, and the flow direction reversing portion limits the flow of ink into the solvent supply tube by constraining the ink, at some point in the flow direction reversing portion, to flow upwards to form a head of ink that acts to prevent any further flow of ink into the solvent supply tube.

2. A print head according to claim 1, wherein the solvent supply tube is arranged with a loop, of which the flow direction reversing portion of the solvent supply tube forms a part.

3. A print head according to claim 2, further comprising a former for the loop, the former being configured to receive and secure a loop of the solvent supply tube.

4. An inkjet printer including a print head according to claim 1.

5. A former for a solvent supply tube, the former comprising a receiving portion for receiving a loop of a solvent supply tube to define a minimum internal diameter of the loop of the solvent supply tube, and a securing portion for securing at least a portion of the loop of the solvent supply tube in engagement with the receiving portion of the former, wherein the former comprises at least two bars with at least one of a receiving portion and a securing portion at each end of each bar, and a first bar of the two bars is provided with a receiving portion at each end and a second bar of the two bars is provided with a securing portion at each end.

6. A former according to claim 5, wherein the two bars are joined at their midpoints and arranged substantially at right angles to one another.

7. A former according to claim 5, wherein the receiving portion is constituted by a pair of fingers.

8. A former according to claim 5, wherein the securing portion is constituted by at least one aperture for receiving and securing the solvent supply tube.

9. A former according to claim 8, wherein one of the securing portions is constituted by a single aperture and the other of the securing portions is constituted by a pair of apertures arranged side by side.

* * * * *